US011679611B2

(12) United States Patent
Wilflingseder

(10) Patent No.: US 11,679,611 B2
(45) Date of Patent: Jun. 20, 2023

(54) HAND-OPERATED STAMP HAVING A TILTING ELEMENT

(71) Applicant: COLOP STEMPELERZEUGUNG SKOPEK GESELLSCHAFT M.B.H. & CO. KG., Wels (AT)

(72) Inventor: Johann Wilflingseder, Dorf an der Pram (AT)

(73) Assignee: COLOR STEMPELERZEUGUNG SKOPEK GESELLSCHAFT M.B.H. & CO. KG., Wels (AT)

( * ) Notice: Subject to any disclaimer, the term of this patent is extended or adjusted under 35 U.S.C. 154(b) by 0 days.

(21) Appl. No.: 17/425,516

(22) PCT Filed: Jan. 27, 2020

(86) PCT No.: PCT/AT2020/060025

§ 371 (c)(1),
(2) Date: Jul. 23, 2021

(87) PCT Pub. No.: WO2020/150764

PCT Pub. Date: Jul. 30, 2020

(65) Prior Publication Data

US 2022/0088954 A1 Mar. 24, 2022

(30) Foreign Application Priority Data

Jan. 25, 2019 (AT) ..... A 50058/2019

(51) Int. Cl.
*B41F 1/02* (2006.01)
*B41K 1/02* (2006.01)
(Continued)

(52) U.S. Cl.
CPC ..... *B41K 1/02* (2013.01); *B41K 1/42* (2013.01); *B41K 1/50* (2013.01)

(58) Field of Classification Search
CPC ..... B41K 1/02; B41K 1/42; B41K 1/50
See application file for complete search history.

(56) References Cited

U.S. PATENT DOCUMENTS 3,380,378 A 4/1968 Edwards et al.
4,149,459 A 4/1979 Flynn et al.
(Continued)

FOREIGN PATENT DOCUMENTS

AT 006 732 U1 3/2004
CN 1455737 A 11/2003
(Continued)

OTHER PUBLICATIONS

International Search Report in PCT/AT2020/060023, dated May 15, 2020.
(Continued)

*Primary Examiner* — Christopher E Mahoney
*Assistant Examiner* — Marissa Ferguson-Samreth
(74) *Attorney, Agent, or Firm* — Collard & Roe, P.C.

(57) ABSTRACT

A hand-operated stamp (1) comprising a housing (2) in which a stamp unit (3) coupled to an actuating part (8) which can be displaced with respect to the housing (2) is mounted, wherein the actuating part (8) has a locking element (10, 10') for limiting a displacement of the actuating part (8) with respect to the housing (2), wherein the locking element (10, 10') is configured as a rocker element (10*a*) on a pivot shaft (14), wherein the actuating part (8) has a recess (22) for receiving the rocker element (10*a*), wherein the pivot shaft (14) is arranged in the recess (22), wherein the actuating part (8) has a supporting strut (23) in the recess (22), wherein the supporting strut (23) is arranged parallel to the pivot shaft (14).

12 Claims, 2 Drawing Sheets

(51) Int. Cl.
*B41K 1/42* (2006.01)
*B41K 1/50* (2006.01)

(56) References Cited

U.S. PATENT DOCUMENTS

| | | | |
|---|---|---|---|
| 7,380,497 | B2 | 6/2008 | Faber |
| 7,464,643 | B2 | 12/2008 | Pointl |
| 7,520,221 | B2 | 4/2009 | Ameshofer |
| 8,104,402 | B2 | 1/2012 | Feilecker et al. |
| 9,221,287 | B2 | 12/2015 | Faber |
| 9,399,368 | B2 | 7/2016 | Drinic et al. |
| 10,632,775 | B2 | 4/2020 | Riegler et al. |
| 2003/0150343 | A1 | 8/2003 | Koneczny |

FOREIGN PATENT DOCUMENTS

| | | | |
|---|---|---|---|
| CN | 1856407 | A | 11/2006 |
| CN | 104936790 | A | 9/2015 |
| DE | 1890974 | U | 4/1964 |
| DE | 43 09 400 | A1 | 9/1993 |
| DE | 44 42 748 | A1 | 6/1996 |
| DE | 296 01 203 | U1 | 5/1997 |
| DE | 298 12 303 | U1 | 9/1998 |
| DE | 100 57 531 | A1 | 6/2002 |
| DE | 10 2004 051 084 | A1 | 4/2006 |
| DE | 10 2012 109 315 | A1 | 4/2014 |
| EP | 0 637 494 | A1 | 2/1995 |
| EP | 1 323 525 | A2 | 7/2003 |
| GB | 253716 | A | 6/1926 |
| JP | H10-297072 | A | 11/1998 |
| JP | 2002-160436 | A | 6/2002 |
| JP | 2008-173919 | * | 1/2007 |
| JP | 2008-173919 | A | 7/2008 |
| JP | 2018-167571 | A | 11/2018 |
| WO | 97/26814 | A2 | 7/1997 |
| WO | 2006/079130 | A1 | 8/2006 |
| WO | 2007/082330 | A1 | 7/2007 |
| WO | 2014/113832 | A1 | 7/2014 |
| WO | 2016/197171 | A2 | 12/2016 |

OTHER PUBLICATIONS

International Search Report in PCT/AT2020/060025, dated Jun. 2, 2020.

Austrian Office Action and Search Report in A 50060/2019, dated Nov. 7, 2019, with English translation of relevant parts.

Austrian Office Action and Search Report in A 50058/2019, dated Sep. 30, 2019 with English translation of relevant parts.

Chinese Office Action dated Jun. 30, 2022 in Chinese Application No. 202080010569.X with English translation.

* cited by examiner

HAND-OPERATED STAMP HAVING A TILTING ELEMENT

CROSS REFERENCE TO RELATED APPLICATIONS

This application is the National Stage of PCT/AT2020/060025 filed on Jan. 27, 2020, which claims priority under 35 U.S.C. § 119 of Austrian Application No. A 50058/2019 filed on Jan. 25, 2019, the disclosure of which is incorporated by reference. The international application under PCT article 21(2) was not published in English.

BACKGROUND OF THE INVENTION

1. Field of the Invention

The invention relates to a hand-operated stamp comprising a housing in which a stamp unit coupled to an actuating part which can be displaced with respect to the housing is mounted, wherein the actuating part has a locking element for limiting a displacement of the actuating part with respect to the housing, wherein the locking element is configured as a rocker element on a pivot shaft, wherein the actuating part has a recess for receiving the rocker element, wherein the pivot shaft is arranged in the recess. In addition, the invention relates to a method for releasing a locking position of a hand-operated stamp comprising a housing in which a stamp unit coupled to an actuating part which can be displaced with respect to the housing is mounted, wherein the actuating part has a locking element which in the locking position limits a displacement of the actuating part with respect to the housing.

The limiting of the displacement of the actuating part with respect to the housing can be achieved, for example, by means of a lock or fixing of the actuating part on the housing. The invention is not restricted to actuating parts having a single locking element; a plurality of, e.g. two, locking elements can also be provided.

In particular, the invention relates to a self-inking stamp, e.g. with inking in an upside down position. The actuating part can, for example, be arranged as an actuating bar on one side opposite an imprint opening of the housing above the housing. The stamp unit can, for example, comprise a plate carrier with a stamp plate and/or a type unit. Furthermore, a pad container with an ink pad for coloring the stamp plate can be provided in the housing. However, the invention is fundamentally independent of an inking mechanism and can be applied in principle to any hand-operated stamp in which a stamp unit is accommodated in a housing and can be displaced at least partially from the housing by means of the actuating part to create an imprint.

2. Description of the Related Art

In connection with self-inking stamps, it is known that the actuating part can be fixed at one or more positions on the housing. For example, AT 006 732 U1 discloses an actuating part with latching elements which can be engaged in a hook-like manner in corresponding engagements in order to fix the actuating part in a somewhat depressed intermediate position when viewed relative to the housing and in order to be able to exchange an ink pad container in this intermediate position.

WO 2014/113832 A1 discloses a self-inking stamp having a housing and an actuating part wherein locking elements are provided on the actuating part, which are movable resiliently inwards and which can cooperate with latching recesses on the narrow sides of the housing in order to fix the actuating part on the housing in various predefined positions.

The known stamps have in common that in order to release the limitation or fixing, the actuating part is displaced relative to the housing and against the spring force of a restoring spring provided between housing and actuating part. This movement is not intuitive since in order to raise the actuating part from the fixed position or locking position, initially a movement in the opposite direction is required. When a stamp is used for the first time, which stamp is usually supplied in a space-saving manner in the locking position, the user could therefore have difficulties during operation and have a poor first impression because of a lack of knowledge of the mechanism. Regardless of this, in the known solutions the locking position can easily be released accidentally if the actuating part is displaced with respect to the housing for other reasons, e.g. when putting down or packing the stamp. Subsequently, the stamp plate is inked on the ink pad and the stamp therefore has first traces of use and can no longer be sold as a new stamp.

JP H10297072 A discloses a stamp having a locking mechanism with a rocker element mounted on a pivot shaft to prevent a relative movement between an actuating part and a housing. This locking mechanism serves to prevent an undesired actuation of the stamp. A resetting of the stamp from the locking position (e.g. delivery position or imprint position) into the rest position (e.g. ink position) is therefore not prevented or limited.

JP 2018167571 A also discloses a stamp with a locking mechanism having a rocker element. The actuating part can thus be fixed relative to the housing in such a manner that the stamp remains in the imprint position so that the stamp pad can be exchanged more easily.

JP 2008173919 A discloses a stamp in which a locking mechanism with a rocker element is attached to the actuating part on the outside, i.e. in a projecting structure.

JP 2002160436 A discloses a stamp with a different type of locking mechanism comprising a rocker element, wherein the pivot shaft is arranged parallel to the displacement axis, along which the actuating part can be displaced with respect to the housing. In this case, the rocker element is part of the housing and not the actuating part.

WO 2016197171 A2 also discloses a different type of locking mechanism. In this case, a U-shaped rocker element spans the entire housing. The rocker element in this case is accommodated in a hollow actuating part. The pivot shaft of the rocker element is parallel to a longer side of the housing. It therefore grips on fastening supports provided specifically for this purpose on the housing. This locking mechanism is associated with considerable manufacturing costs as a result of the complex construction.

GB 253716 A discloses another different type of locking mechanism on a stamp. In this case, a locking element is arranged on the housing.

SUMMARY OF THE INVENTION

It is the object of the invention to propose a hand-operated stamp and a method for releasing a locking position of a hand-operated stamp. The hand-operated stamp should eliminate or at least reduce at least individual disadvantages of the prior art and should be both simple in structure and cost-effective in production as well as reliable in function.

The invention provides a hand-operated stamp of the type initially cited, wherein the actuating part has a supporting strut in the recess, wherein the supporting strut is arranged parallel to the pivot shaft. As a result of the recess and the pivot shaft arranged therein, an at least partial embedding of the rocker element in the plane of a wall or a leg of the actuating part is possible. The recess can in particular be formed as a passage in the actuating part, e.g. in a wall or a leg of the actuating part. For the purpose of embedding the rocker element, the pivot shaft can in particular be arranged between a plane defined in the region of the recess by the inner side of the actuating part and a plane defined in the region of the recess by the outer side of the actuating part and substantially parallel to these planes. The supporting strut prevents the rocker element from being able to fall into the actuating part during assembly. The supporting strut can also be provided as a stiffening element for stiffening the actuating part in the region of the recess and promotes the reliability of the actuating part. The supporting strut can also serve as a stop for the locking element. In this connection, the supporting strut can be arranged in such a manner that in the locking position it relieves the pivot shaft and the tilt connection from the spring force of the stamp spring (between the actuating part and the housing). The supporting strip promotes the permanent functioning and therefore ultimately the reliability of the locking mechanism by taking over the absorption of force, primarily when the locking element is under tension for a fairly long time. The force then does not go into the more sensitive rocking mechanism. For example, if the axis of rotation consists of a plastic that creeps under permanent load (e.g. ABS, ABS/PA or POM), the supporting strut can prevent or at least delay a permanent deformation of the axis of rotation as a result of the mentioned unloading. A deformation of the axis of rotation could disturb the function of the rocker element so that, for example, a release would be blocked and the hand-operated stamp would thus become unusable.

The locking element is mounted rotatably on the pivot shaft and can thus execute a rocking movement, i.e. a rotating movement within a limited angular range. The locking element thus has two directions of actuation, one each for producing and releasing the limitation. That is, a return of the locking element from a locking position into a release position can be brought about by direct actuation (or operation) of the locking element. In the cited prior art, the release of the limitation cannot be brought about by an actuation of the locking element but instead the actuating part must be actuated which only subsequently initiates a release of the locking elements as a result of their resilient mounting. With the present invention, disadvantages as a result of fatigue of these resilient mountings can be avoided. In addition, it is possible to also fix the actuating part in a position in which there is no further play for the actuating part and this is therefore completely fixed (in the prior art at least a small play against the limitation must always be maintained to enable a release). The formation of the locking element as a rocker element is mechanically particularly easy and reliable to implement. However, other designs of the locking elements are also feasible, e.g. with a locking according to the ball pen principle wherein the limitation is alternately produced or released by sequential actuation (in this case, two actuating directions are achieved with one actuating position). For example, the locking element can have a first actuating position (e.g. an actuating surface) and a second actuating position, wherein the locking element can be moved by actuation of the first actuating position in a first actuating direction which corresponds to a production of the limitation and the locking element can be moved by actuation of the second actuating position in the second actuating direction which corresponds to a release of the limitation. In this case, an actuating position is designated as a localized region which is accessible for an actuation by a user of the hand-operated stamp. The second actuating position is in this case different from the first actuating position. Each actuating position is assigned a different actuating direction.

The actuating direction of the locking element is understood in this case as a movability, wherein a movement of the locking element in the relevant direction can be initiated by actuation of the locking element. The locking element can thus be actuated to produce the limitation and moves in this case in the first actuating direction. The actuating direction can in this case correspond to a translation (rectilinear movement) or a rotation (rotary movement).

In connection with the actuating positions, the locking element can have a marking at the first actuating position and/or at the second actuating position. Such a marking can, for example, be provided as lettering or with a symbol, e.g. with a depicted closed shackle lock at the first actuating position and a depicted open shackle lock at the second actuating position.

According to a disclosed exemplary embodiment, the locking element can have a first actuating position on a first side of the pivot shaft and a second actuating position on a second side of the pivot shaft. The actuating positions can in this case correspond to the afore-mentioned actuating positions. The actuating directions (first and second) are in this case opposite directions of rotation about the pivot shaft. The geometrical arrangement of the first and second side of the pivot shaft therefore depends on the action and the direction of the force effect since this acts as a torque about the pivot shaft. In one form corresponding to a substantially flat rocker switch, the sides on the accessible outer side of the rocker element are separated by a plane normal to the outer side and by the pivot shaft.

The pivot shaft can in particular be arranged in the recess at an offset with respect to the housing. For example, the pivot shaft can be arranged closer to a plane defined by the inner side of the actuating part in the region of the recess than to a plane defined by the outer side of the actuating part in the region of the recess. As a result, more space for receiving and embedding the rocker element remains in the direction of the outer side of the actuating part.

The rocker element can, for example, have a hook projection which extends in the direction of the housing, i.e. in the first actuating direction. For example, in the case of a flat rocker switch, the hook projection can be arranged on a first side of the pivot shaft. The hook projection can penetrate into or engage in a recess on the housing to limit the displacement of the actuating part. The supporting strut can, in this case for example, be arranged between the hook projection and the pivot shaft. As a result, it can support the hook projection and thereby additionally unload the pivot shaft and the tilt connection. For example, if the rocker element with the hook projection consists of a plastic which creeps under permanent loading (e.g. ABS, ABS/PA or POM), the supporting strut can prevent or at least delay a permanent deformation of the rocker element as a result of the support of the hook projection. A deformation of the rocker element could disturb the function of the rocker element so that, for example, no further locking could be achieved and the locking position would be released during transport or storage of the hand-operated stamp.

In this connection, the housing can have a recess for engagement of the hook projection in a locking position.

Compared with a projection or support on the housing, a simpler and more compact construction of the housing is thus achieved.

The recess of the housing can optionally have a slope for lifting out the hook projection from the recess upon depressing the actuating part from the locking position. The slope can, for example, be formed as a bevel and correspond to a propagation of the recess in the direction of the pivot shaft.

In order to prevent a retracting of the rocker element into the actuating part in a stamp inking position (i.e. when the stamp unit rests against an ink pad) and avoid a blockade of the imprint process possibly caused thereby, the actuating part can have a first stop for a movement of the rocker element into the first actuating direction. Such a first stop can, for example, be arranged radially outside a hook projection in relation to the pivot shaft.

According to a preferred exemplary embodiment combined with a hook projection on the rocker elements, the first stop can be arranged radially outside the hook projection in relation to the pivot shaft. In this case, the leverage reduces the structural load of the actuating part in the region of the first stop.

In addition, it is optionally provided that the actuating part has a second stop for a movement of the rocker element into the second actuating direction. With the second stop, an inadvertent locking of the stamp by engagement of the second side (release side) with the housing can be avoided. To release the displacement of the actuating part, the user can simply press the rocker element through to the second stop.

The rocker element is, for example, connected to the pivot shaft by means of a snap-on connection. Such a snap-on connection or such a snapping of the rocker element onto the pivot shaft enables a comparatively simple and rapid assembly of the hand-operated stamp.

Furthermore, the invention provides a method of the type cited initially wherein the locking element is configured as a rocker element and the locking position is released by rocking the locking element about a pivot shaft. In detail, as a result of its actuation, the locking element is transferred from the locking position into a release position (i.e. the locking position is ended, the limitation of the displacement of the actuating part with respect to the housing by the locking element is cancelled and any fixing is released) and rocked. That is, the locking element executes a rotational movement by a fixed angle about the pivot shaft in order to release or end a locking position.

According to an exemplary embodiment disclosed here, the actuation of the locking element to release the locking position comprises the actuation of a second actuating position of the locking element. Conversely, a transfer of the locking element into the locking position is achieved by an actuation of a first actuating position of the locking element.

Within the framework of the disclosed method, the rocking of the locking element can lift out a hook projection of the locking element from a recess in the housing.

Optionally the recess can have a slope and the lifting of the locking element from the locking position upon depressing the actuating part can be brought about by the slope. This simplifies the execution of the method by the user of the hand-operated stamp because the rocker element need not be actuated directly.

BRIEF DESCRIPTION OF THE DRAWINGS

The invention will be explained in further detail hereinafter by means of an exemplary embodiment to which it should not be restricted however and with reference to the drawings. The drawings show in detail:

FIG. 1 shows a hand-operated stamp 1 which is configured as a self-inking stamp with inking in an upside-down position, in a view partially from below, i.e. on a bottom side or imprint side. FIG. 3 shows the same hand-operated stamp 1 in a sectional view along the line of intersection III-III shown in FIG. 2. The hand-operated stamp 1 has a housing 2 in which a stamp unit 3 with a stamp plate 5 mounted on a plate carrier 4 is mounted. Alternatively or additionally to a stamp plate 5, a type unit not shown could also be provided. In the example according to FIG. 1 and FIG. 3, the stamp plate 5 is arranged in an imprint opening 6 at the bottom-side end of the housing 2, i.e. the hand-operated stamp 1 is shown in a space-saving delivery position. In an imprint position the stamp plate 5 would not be completely exposed other than in the delivery position; instead, the printing plate or printing relief of the stamp plate 5 would lie in one plane with the underside of the housing 2, namely in the plane defined, for example, by the surface of the object to be marked. For displacement of the stamp unit 3 between a rest position or stamp inking position of the hand-operated stamp 1 not shown but known to the person skilled in the art, in which the stamp plate 5 rests on an ink pad 7 (cf. FIG. 3) and the imprint position or the delivery position, the stamp unit 3 is coupled to an actuating part 8 which can be displaced with respect to the housing 2. The actuating part 8 or an actuating clip is arranged at least partly above the housing 2 and can be easily gripped by a user and actuated by pressing down from the rest position in the direction of the object to be stamped into the imprint position. A restoring spring 9 shown in FIG. 3 can return the stamp unit 3 from the imprint position into the rest position.

DETAILED DESCRIPTION OF THE PREFERRED EMBODIMENTS

Figure 1:
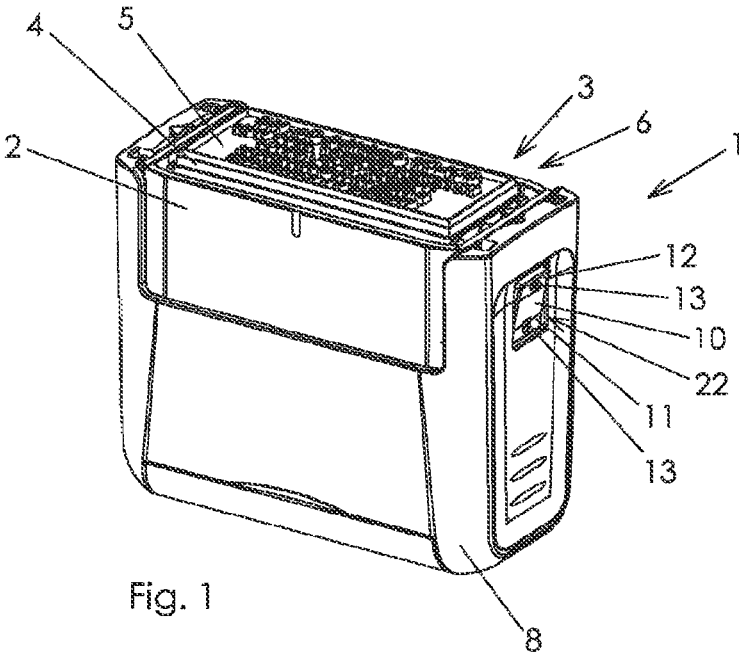
FIG. 1 shows a perspective view of a hand-operated stamp from above according to the invention in which, inter alia, a bottom side, a broad side and a narrow side which has a locking element can be seen.
Figure 2:
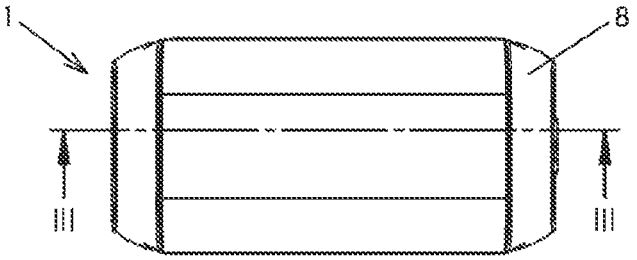
FIG. 2 shows the hand-operated stamp from FIG. 1 from above.
Figure 3:
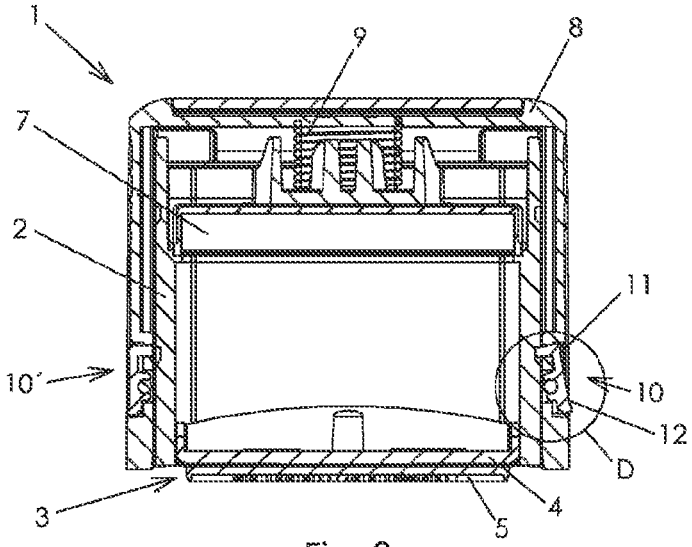
FIG. 3 shows a sectional view through the hand-operated stamp along the line III-III shown in FIG. 2.

It is also clearly recognizable in FIG. 1 and FIG. 3 that the actuating part 8 has a locking element 10 which is arranged on a narrow side of the hand-operated stamp 1 or the actuating part 8. Preferably a second such locking element 10' is additionally provided on an opposite narrow side of the hand-operated stamp 1 or of the actuating part 8 which cannot be seen in FIG. 1. The locking element 10, 10' is used to limit a displacement or a displacement path of the actuating part 8 with respect to the housing 2. Thus, with the locking element 10, 10' the actuating part 8 can be fixed in a defined position in relation to the housing 2. The locking element 10, 10' has a first actuating direction R1 which corresponds to production of the limitation and the locking element 10, 10' has a second actuating direction R2 which corresponds to a release of the limitation, cf. FIG. 4. Thus, by moving the locking element 10, 10' into the first actuating direction R1, the user can fix the actuating part 8 in relation to the housing 2 and by moving the locking element 10, 10' in the second actuating direction R2, can release the actuating part 8 in relation to the housing 2 and then displace or have it transferred into the rest position by the action of the restoring spring 9.

The locking element 10, 10' has a first actuating position 11 and a second actuating position 12, wherein the locking element 10, 10 can be moved in the first actuating direction R1 by actuation of the first actuating position 11 and the locking element 10, 10' can be moved in the second actuating direction R2 by actuation of the second actuating position 12.

In FIG. 1 it can further be identified that the locking element 10, 10' has a marking 13 at the first actuating position 11 and/or at the second actuating position 12. The marking 13 can, for example, be a lettering or a symbol.

Figure 4:
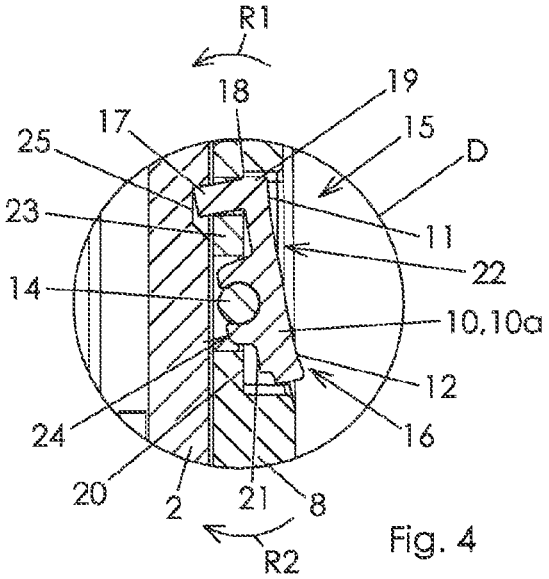
FIG. 4 shows an enlarged view of the detail D from FIG. 3.

FIG. 4 shows the detail D from FIG. 3 on an enlarged scale in which the locking element 10 can be seen in a locking position which prevents any displacement of the actuating part 8 with respect to the housing 2. The second locking element 10' not shown in FIG. 4 is preferably constructed in the same manner. The locking element 10 is configured as a rocker element 10*a*, for example, in the form of a flat rocker switch on a pivot shaft 14. The rocker element 10*a* is mounted rotatably on the pivot shaft 14, more precisely slidingly mounted on the substantially cylindrical pivot shaft 14. The rocker element 10*a* comprises the first actuating position 11 on a first side 15 of the pivot shaft 14 and the second actuating position 12 on a second side 16 of the pivot shaft 14. The second side 16 is arranged opposite the first side 15 in relation to the pivot shaft 14.

In the example shown, the rocker element 10*a* has a hook projection 17 which extends in the first actuating direction R1 and in the assembled state of the hand-operated stamp 1 in the direction of the housing 2. In this case, the hook projection 17 is located on the first side 15 of the pivot shaft 14. In particular, the hook projection 17 engages in a recess 25 in the housing 2 in the locking position shown in FIG. 4.

In the example shown, the actuating part 8 has a first stop 18 for a movement of the rocker element 10*a* in the first actuating direction R1. The first stop 18 is, for example, configured as an edge which is arranged radially outside the hook projection 17 in relation to the pivot shaft 14. Accordingly, a corresponding projection 19 is provided on the rocker element 10*a* which is configured to rest on the first stop 18 (edge) when the rocker element 10*a* is moved sufficiently far in the first actuating direction R1, i.e. into the locking position. The first stop 18 thus limits the movement of the rocker element 10*a* in the first actuating direction R1.

The actuating part 8 according to the depicted example additionally has a second stop 20 for a movement of the rocker element 10*a* in the second actuating direction R2. As can be identified in FIG. 4, the first actuating direction R1 and the second actuating direction R2 are mutually opposite directions of rotation. Accordingly, a corresponding contact surface 21 is provided on the rocker element 10*a*, which is configured for resting on the second stop 20 when the rocker element 10*a* is moved sufficiently far in the second actuating direction R2, i.e. into the release position. The second stop 20 thus limits the movement of the rocker element 10*a* into the second actuating direction R2. The second locking element 10' is also configured as a similar rocker element and shown for illustration in FIG. 3 in the release position. In practice, usually both locking elements 10, 10' will either adopt the release position or the locking position at the same time. According to the example shown, the actuating part 8 further has a recess 22 for receiving the rocker element 10*a*, wherein the pivot shaft 14 is arranged in an offset manner in the recess 22 with respect to the housing 2. Thus, a large part of the rocker element 10*a* is received in the recess 22. In the release position of the rocker element 10*a* (cf. the second locking element 10'), the outer surface of the rocker element 10*a* with the actuating positions 11, 12 is substantially inserted in the plane of the flat side wall of the actuating part 8 and does not emerge therefrom.

According to the example shown, the actuating part 8 also has a supporting strut 23 in the recess 22, wherein the supporting strut 23 is arranged parallel to the pivot shaft 14. The supporting strut 23 can be arranged as in FIG. 4 between the hook projection 17 and the pivot shaft 14 and can thereby also serve as a stop for limiting the movement of the rocker element 10*a* in the first actuating direction R1.

In the example shown in FIG. 3 and FIG. 4 the rocker element 10*a* is connected to the pivot shaft 14 by means of a snap-on connection 24.

The invention claimed is:

1. A hand-operated stamp (1) comprising a housing (2) in which a stamp unit (3) coupled to an actuating part (8) which can be displaced with respect to the housing (2) is mounted, wherein the actuating part (8) has a locking element (10, 10') for limiting a displacement of the actuating part (8) with respect to the housing (2), wherein the locking element (10, 10') is configured as a rocker element (10*a*) on a pivot shaft (14), wherein the actuating part (8) has a recess (22) for receiving the rocker element (10*a*), wherein the pivot shaft (14) is arranged in the recess (22), wherein the actuating part (8) has a supporting strut (23) in the recess (22), wherein the supporting strut (23) is arranged with a main extension of the supporting strut parallel to the pivot shaft (14), and wherein in a release position of the locking element (10, 10'), the supporting strut (23) is at a distance to the rocker element (10*a*).

2. The hand-operated stamp (1) according to claim 1, wherein the pivot shaft (14) is arranged in the recess (22) offset towards the housing (2).

3. The hand-operated stamp (1) according to claim 1, wherein the rocker element (10*a*) has a hook projection (17) which extends in the direction of the housing (2).

4. The hand-operated stamp (1) according to claim 3, wherein the housing (2) has a recess (25) for engagement of the hook projection (17) in a locking position.

5. The hand-operated stamp (1) according to claim 4, wherein the recess (25) of the housing (2) has a slope for lifting out the hook projection (17) from the recess (25) upon depressing the actuating part (8) from the locking position.

6. The hand-operated stamp (1) according to claim 1, wherein the actuating part (8) has a first stop (18) for a movement of the rocker element (10*a*) into the first actuating direction (R1).

7. The hand-operated stamp (1) according to claim 6, wherein the first stop (18) is arranged radially outside the hook projection (17) in relation to the pivot shaft (14).

8. The hand-operated stamp (1) according to claim 1, wherein the actuating part (8) has a second stop (20) for a movement of the rocker element (10*a*) into the second actuating direction (R2).

9. The hand-operated stamp (1) according to claim 1, wherein the rocker element (10*a*) is connected to the pivot shaft (14) by means of a snap-on connection (24).

10. A method for entering and releasing a locking position of a hand-operated stamp (1) comprising a housing (2) in which a stamp unit (3) coupled to an actuating part (8) which can be displaced with respect to the housing (2) is mounted, wherein the actuating part (8) has a locking element (10, 10') which in the locking position limits a displacement of the actuating part (8) with respect to the housing (2), wherein the locking element (10, 10') is configured as a rocker element (10*a*) and the locking position is entered and released by rocking the locking element (10, 10*a*) about a pivot shaft (14) towards or away from a supporting strut (23) which is arranged in a recess (22) of the actuating part (8) and has a main extension parallel to the pivot shaft (14).

11. The method according to claim 10, wherein the rocking of the locking element (10, 10') lifts out a hook projection (17) of the locking element (10, 10') from a recess (25) in the housing (2).

12. The method according to claim 11, wherein the recess (25) has a slope and the lifting of the locking element (10, 10*a*) from the locking position upon depressing the actuating part (8) is brought about by the slope.

* * * * *